US008247988B2

(12) United States Patent
Kling et al.

(10) Patent No.: US 8,247,988 B2
(45) Date of Patent: Aug. 21, 2012

(54) COMPACT DELAY LINE STRUCTURES FOR FIELD APPLICATORS FOR OPERATION OF ELECTRODELESS GAS DISCHARGE LAMPS

(75) Inventors: Rainer Kling, Dossenheim (DE); Michael Meisser, Karlsruhe (DE); Klaus Stockwald, Germering (DE)

(73) Assignee: Karlsruher Institut fuer Technologie, Karlsruhe (DE)

( * ) Notice: Subject to any disclaimer, the term of this patent is extended or adjusted under 35 U.S.C. 154(b) by 382 days.

(21) Appl. No.: 12/749,563

(22) Filed: Mar. 30, 2010

(65) Prior Publication Data

US 2010/0244722 A1 Sep. 30, 2010

Related U.S. Application Data

(60) Provisional application No. 61/165,230, filed on Mar. 31, 2009.

(51) Int. Cl.
*H05B 41/16* (2006.01)

(52) U.S. Cl. ..... 315/248; 315/39; 315/294

(58) Field of Classification Search ..... 315/39, 315/39.3, 267, 344, 294
See application file for complete search history.

(56) References Cited

U.S. PATENT DOCUMENTS

| | | | | |
|---|---|---|---|---|
| 5,113,121 | A * | 5/1992 | Lapatovich et al. | 315/248 |
| 5,498,928 | A | 3/1996 | Lapatovich et al. | |
| 5,821,698 | A * | 10/1998 | Lapatovich | 315/248 |
| 5,844,376 | A * | 12/1998 | Lapatovich | 315/248 |
| 6,559,607 | B1 * | 5/2003 | Ervin et al. | 315/248 |
| 2002/0167282 | A1 * | 11/2002 | Kirkpatrick et al. | 315/248 |
| 2007/0075652 | A1 | 4/2007 | Espiau et al. | |
| 2011/0133663 | A1 * | 6/2011 | Stockwald | 315/246 |

FOREIGN PATENT DOCUMENTS

| | | | |
|---|---|---|---|
| DE | 10335523 | B4 | 4/2009 |
| EP | 0457242 | A1 | 11/1991 |

OTHER PUBLICATIONS

English language abstract for DE 10335523 B4.
1st part of dissertation of Berthold Koch.
2nd part of dissertation of Berthold Koch.
English language summary of 1st and 2nd part of dissertation of Berthold Koch.

* cited by examiner

*Primary Examiner* — Don Le

(57) ABSTRACT

In various embodiments, an electrodeless high intensity discharge lamp is provided, which may include a bulb containing a fill mixture for generating a light emission when excited by microwave energy; and at least two applicator arms for coupling the microwave energy to the fill mixture, the at least two applicator arms being separated by at least one delay line, the at least one delay line comprising a stripline structure.

17 Claims, 2 Drawing Sheets

COMPACT DELAY LINE STRUCTURES FOR FIELD APPLICATORS FOR OPERATION OF ELECTRODELESS GAS DISCHARGE LAMPS

CROSS-REFERENCE TO RELATED APPLICATION

This application claims the benefit of U.S. Patent Application Ser. No. 61/165,230, which was filed Mar. 31, 2009, and is incorporated herein by reference in its entirety.

TECHNICAL FIELD

Various embodiments relate to the field of electrodeless high pressure discharge lamps (EHID), e.g. configured for general illumination or photo-optical application. By way of example, various embodiments relate to Compact Delay Line Structures for Field Applicators for Operation of Electrodeless Gas Discharge Lamps.

BACKGROUND

From US-A 2009146543 plasma lamps are known. They are based on electrodeless high pressure discharge lamps which are often referred to as EHID. This citation is incorporated herein by reference.

Further References which deal with plasma lamps of this kind are:

Koch, B. (2002). Experimental examinations on new compact microwave resonators for electrodeless excitation of high-pressure discharge lamps. Light technical institute. Karlsruhe, University Karlsruhe; Dissertation [Experimentelle Untersuchungen an neuartigen kompakten Mikrowellenresonatoren zur elektrodenlosen Anregung von Hochdruckentladungslampen. Lichttechnisches Institut. Karlsruhe, Universität Karlsruhe; Dissertation.]

A device for plasma excitation by means of microwaves is disclosed as DE-A 103 35 523.

Details for Electrodeless HID Lamp with Microwave Power Coupler are published under CA-A 2 042 258 and CA-A 2 042 251.

SUMMARY

In various embodiments, an electrodeless high intensity discharge lamp is provided, which may include a bulb containing a fill mixture for generating a light emission when excited by microwave energy; and at least two applicator arms for coupling the microwave energy to the fill mixture, the at least two applicator arms being separated by at least one delay line, the at least one delay line comprising a stripline structure.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide an improved electrodeless high intensity discharge (EHID) lamp.

Various embodiments provide one or more of the following features:

For electrode-less high intensity discharge (EHID) lamp operation, high electric field densities are coupled into the lamp volume to generate high intensity light output. To allow high field strengths between the different field applicators, a phase delay between the applicator arms must be generated. Typical phase shifts are in the range of ¼ or ½ of wavelength $\lambda$.

Especially at operation frequencies below 1 GHz the geometric length of the delay lines is quite long, in the range of 30 cm. The use of dielectric materials such as aluminum oxide reduces this geometric length only by a factor of $\sqrt{\epsilon_r}$.

Typical values for $\epsilon_r$ of low loss materials are 5 to 10 and therefore the length is reduced by approximately a factor of 3.

The relatively great dimensions of the delay lines prevent the space-effective construction of the coupling structure, rise costs and due to the plane arrangement, EMI is not well damped.

Referring to CA-A 2 042 258 and CA-A 2 042 251 delay lines for EHID lamps can be built using delay lines on substrate. These structures use only two dimensions and therefore require a lot of space. Basing on (Koch 2002) and DE-A 103 35 523 applicator structures using four applicator arms can be set up, using four delay lines. At frequencies above 1 GHz delay lines in air are used.

The technical characteristics of the invention include the use of layer structures (sandwich structures) for the realization of delay lines for the application of electromagnetic fields in a gas discharge lamp in extremely low volume. For this purpose, the substrates, which carry on one side the delay line and at the opposite side the ground plane, are linked together to produce Microstrip lines. These are further stacked and connected together through vias, thereby lowering the dimensions needed for the whole structure. At the points of power output, the Mircostrip lines where lead to the edge of the substrate and are then connected with the applicator arms.

Figure 1:
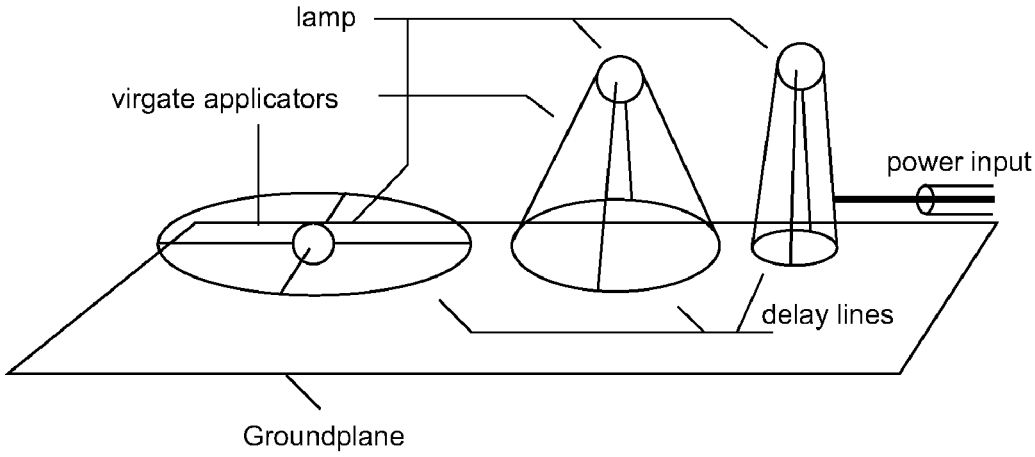
FIG. 1 shows an applicator structure with applicators and delay lines in air.

FIG. 1 shows an applicator structure with applicators and delay lines in air referring to (Koch 2002) and DE-A 103 35 523.

Figure 2:
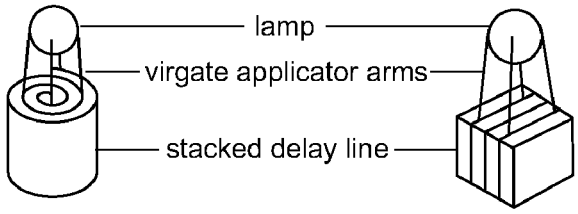
FIG. 2 shows a delay line with a flexible substrate.

FIG. 2 shows a delay line with a flexible substrate as a wrap (left) or with rigid substrate (right) as a sandwich. The delay line using air as a dielectric material would have relatively large proportions at frequencies below 1 GHz. Various embodiments are made in accordance with the reduction of the geometric dimensions, in the way of using the delay lines in Strip or Microstrip Line configuration, either with the use of flexible carrier material (e.g. Teflon) wound to a wrap or with the use of a rigid substrate (Al2O3) in sandwich configuration. The substrate has a relative dielectric constant $\epsilon_r$ larger than 1. The contacting of the various strip line layer is done using appropriate line distributed vias. The delay lines thus form a compact unit with low optical shadowing.

Figure 3:
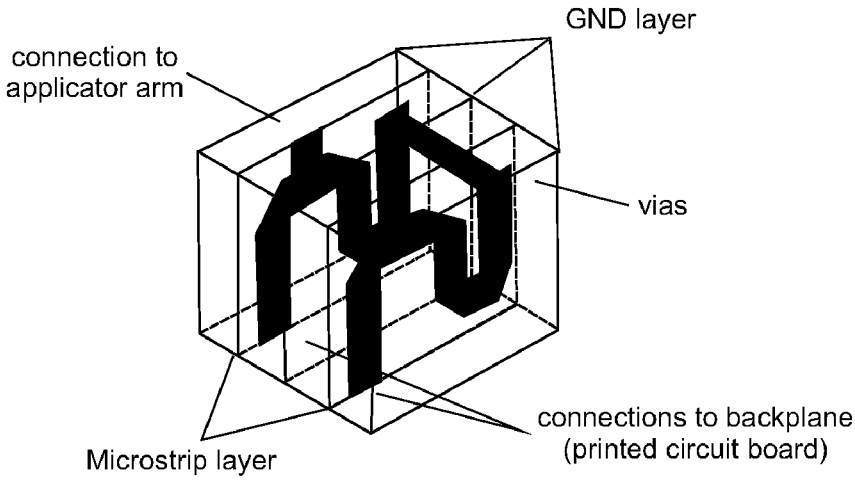
FIG. 3 shows a sandwich structure with two delay line layers and three ground layers.

FIG. 3 shows a sandwich structure with two delay line layers and three ground layers. Four dielectric layers are required. The inter-layer connection is performed using multiple vias. A disadvantage compared to a wrap design is to see in the inhomogeneities in electrical field distribution (and therefore the line impedance) produced by the inter-layer connections leading to reflections of power. Within a layer, line impedance can be kept constant by sufficient design of any edge following ordinary design rules.

Figure 4:
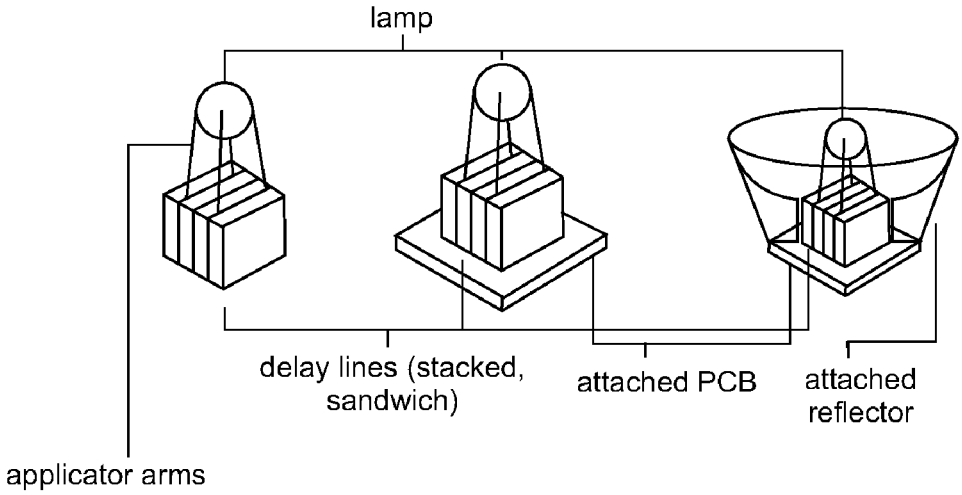
FIG. 4 shows a lamp, an applicator and a reflector forming a compact unit.

FIG. 4 shows a system where lamp, applicator and reflector form a compact unit. The electronics board (PCB) to generate high-frequency voltage by means of semiconductors is mounted directly below. The reflector is at least partially conductive coated or is made of electrical and thermal conductive material and connected with the bulk systems' ground to get a shielding effect cancelling EMI noise. The reflector is at least partly made of thermally conductive material serves as a heat sink for lamp, delay lines and power electronics. The reflector has a good thermal connection with the PCB and the delay line block.

Figure 5:
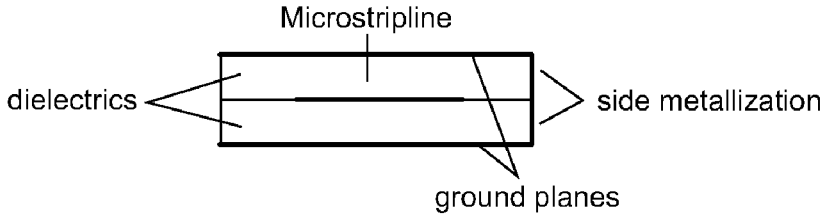
FIG. 5 shows One-layer Set-up of a Microstrip line.

FIG. 5 shows a one-layer set-up of a Microstrip line with side metallization.

Figure 6:
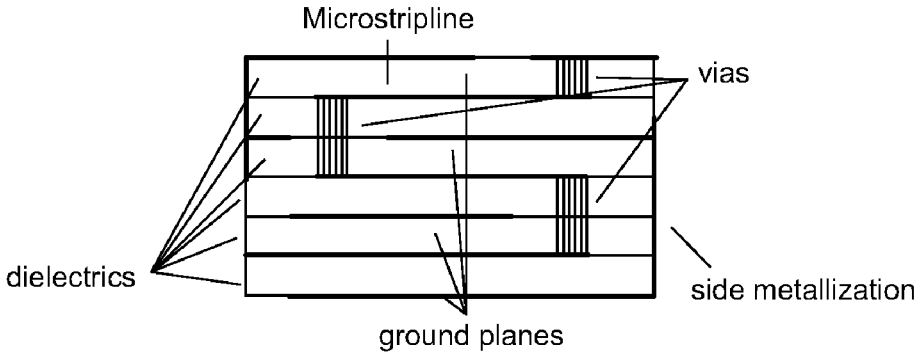
FIG. 6 shows a stack of Microstrip lines.

FIG. 6 shows a stack of Microstrip lines which are electrically connected by means of vias The whole lamp may include one or more of the following features:

(a) a waveguide having a body of a preselected shape and dimensions, the body including at least one dielectric material and having at least one surface determined by a waveguide outer surface, each said material having a dielectric constant greater than approximately 2;

(b) a first microwave probe positioned within and in intimate contact with the body, adapted to couple microwave energy into the body from a microwave source having an output and an input and operating within a frequency range from about 0.25 GHz to about 30 GHz at a preselected frequency and intensity, the probe connected to the source output, said frequency and intensity and said body shape and dimensions selected so that the body resonates in at least one resonant mode having at least one electric field maximum;

(c) the body having a lamp chamber depending from said waveguide outer surface and determined by a chamber aperture and a chamber enclosure determined by a bottom surface and at least one surrounding wall surface;

(d) a transparent, dielectric bulb within the lamp chamber; and (e) a fill mixture contained within the bulb which when receiving microwave energy from the resonating body forms a light-emitting plasma.

More generally a plasma lamp is disclosed including a fill of fill mixture contained within a bulb which when receiving microwave energy from a resonating body forms a light-emitting plasma wherein the fill may include organic compounds chosen from a group which includes acetylene, methane, propane, butane, and acetylides.

Various embodiments provide a stratification of delay lines, required for the generation of phase shifted electric fields to feed into EHID lamps, to minimize the geometric dimensions of the delay lines especially for large wavelengths (lower frequencies).

Various embodiments provide an execution of the stratification as mentioned above, by tacking together rigid or flexible dielectric materials which carry a structured conductor on one or both sides.

Various embodiments provide an execution of the stratification as mentioned above, by establishing a curler made of at least occasionally flexible dielectric substrate which carries a structured conductor on one or both sides.

Various embodiments provide using of vias or other types of conductive connections between the different, dielectric separated, conductors to produce delay lines distributed to more than one layer in order to minimize the size of the lamp referring to FIG. 3.

Various embodiments provide a design of connections to applicator arms in that way, that creepage distances are maximized in order to prevent electric flashover.

Various embodiments provide an execution of the stratification as mentioned above, with an arrangement of the applicator structure behind the lamp referring to FIG. 2 and FIG. 3 in that way, that an optical reflector can be put between delay line structure and lamp bulb.

Various embodiments provide a coating of the surface of the delay line structure with an conductive material and conductive connection of this material with System ground to establish an electric shielding.

Various embodiments provide at least partly a metallisation of the reflector as described above and electrical connection of this metallization to system ground to establish an electric shielding.

Various embodiments provide an electrodeless high pressure discharge lamp including: (a) a waveguide having a body of a preselected shape and dimensions, the body comprising at least one dielectric material and having at least one surface determined by a waveguide outer surface, each said material having a dielectric constant greater than approximately two; (b) a first microwave probe positioned within and in intimate contact with the body, adapted to couple microwave energy into the body from a microwave source having an output and an input and operating within a frequency range from about 0.25 GHz to about 30 GHz at a preselected frequency and intensity, the probe connected to the source output, said frequency and intensity and said body shape and dimensions selected so that the body resonates in at least one resonant mode having at least one electric field maximum; (c) the body having a lamp chamber depending from said waveguide outer surface and determined by a chamber aperture and a chamber enclosure determined by a bottom surface and at least one surrounding wall surface; (d) a transparent, dielectric bulb within the lamp chamber; and (e) a fill mixture contained within the bulb which when receiving microwave energy from the resonating body forms a light-emitting plasma.

Various embodiments provide compact delay line structures for field applicators for operation of electrodeless gas discharge lamps.

Various embodiments provide a stratification of delay lines, required for the generation of phase shifted electric fields to feed into EHID lamps, to minimize the geometric dimensions of the delay lines especially for large wavelengths (lower frequencies).

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An electrodeless high intensity discharge lamp, comprising:

a bulb containing a fill mixture for generating a light emission when excited by microwave energy; and at least two applicator arms for coupling the microwave energy to the fill mixture, the at least two applicator arms being separated by at least one delay line, the at least one delay line comprising a stripline structure.

2. The electrodeless high intensity discharge lamp according to claim 1, wherein the stripline structure comprises a pair of parallel ground planes separated by a dielectric layer; and at least one conductor embedded within the dielectric layer.

3. The electrodeless high intensity discharge lamp according to claim 1, wherein the stripline structure comprises a plurality of stacked stripline structures, wherein each stripline structure comprises a pair of parallel ground planes separated by a dielectric layer; and at least one conductor embedded within the dielectric layer.

4. The electrodeless high intensity discharge lamp according to claim 3, wherein each conductor of each stacked stripline structure are electrically interconnected.

5. The electrodeless high intensity discharge lamp according to claim 2, wherein the dielectric constant of the dielectric layer of each stripline structure is greater than 2 and preferably smaller than 11.

6. The electrodeless high intensity discharge lamp according to claim 2, wherein the dielectric material is substantially rigid.

7. The electrodeless high intensity discharge lamp according to claim 2, wherein the dielectric material is substantially flexible.

8. The electrodeless high intensity discharge lamp according to claim 1, wherein at least one side wall of the stripline structure is metallised.

9. The electrodeless high intensity discharge lamp according to claim 8, wherein the at least one metallised side wall electrically interconnects the ground planes of the stripline structure.

10. The electrodeless high intensity discharge lamp according to claim 2, wherein the at least two applicator arms are connected in the plane of the layers of the stripline structure and mounted on a top surface of the stripline structure, the top surface being a plane which is perpendicular to the plane of the layers of the stripline structure.

11. The electrodeless high intensity discharge lamp according to claim 10, wherein a PCB is mounted to the bottom surface of the stripline structure, the bottom plane being perpendicular to the plane of the layers of the stripline structure and opposite the top surface of the stripline structure.

12. The electrodeless high intensity discharge lamp according to claim 11, wherein the lamp further comprises a reflector, the reflector being mounted onto the PCB to surround the stripline structure, the applicator arms and the bulb of the lamp.

13. The electrodeless high intensity discharge lamp according to claim 12, wherein the reflector is at least partly electrically conductive.

14. The electrodeless high intensity discharge lamp according to claim 12, wherein the reflector is at least partly thermally conductive.

15. The electrodeless high intensity discharge lamp according to claim 1, wherein the lamp further comprises a microwave probe positioned within and in intimate contact with the stripline structure, the microwave probe being adapted to couple the microwave energy from a microwave source to the stripline structure.

16. The electrodeless high intensity discharge lamp according to claim 1, wherein the stripline structure has at least one resonant mode having at least one electric field maximum when excited by the microwave energy.

17. The electrodeless high intensity discharge lamp according to claim 1, wherein the fill mixture comprises organic compounds containing at least one of acetylene, methane, propane, butane and acetylides.

* * * * *